US005366137A

United States Patent [19]

Gysi et al.

[11] Patent Number: 5,366,137

[45] Date of Patent: Nov. 22, 1994

[54] METHOD AND APPARATUS FOR SHAPING METAL SHEETS INTO CAN BODIES AND FEEDING THE CAN BODIES TO A WELDING STATION

[75] Inventors: Peter Gysi, Bellikon; Armin Ineichen, Wohlen; Gideon Levy, Orselina, all of Switzerland

[73] Assignee: Elpatronic AG, Zug, Switzerland

[21] Appl. No.: 72,178

[22] Filed: Jun. 3, 1993

[30] Foreign Application Priority Data

Jun. 18, 1992 [CH] Switzerland ..... 01 925/92-1

[51] Int. Cl.[5] ..... B23K 31/02

[52] U.S. Cl. ..... 228/147; 219/64; 228/17.5; 72/52; 72/181

[58] Field of Search ..... 228/17, 17.5, 147, 151; 219/64; 72/52, 181

[56] References Cited

U.S. PATENT DOCUMENTS

| | | | |
|---|---|---|---|
| 2,864,933 | 12/1958 | Smith | 219/64 |
| 3,204,847 | 9/1965 | Vitense | 228/14 |
| 3,791,020 | 2/1974 | Babbitt | 228/17 X |
| 4,905,885 | 3/1990 | Hellman, Sr. | 219/64 X |

FOREIGN PATENT DOCUMENTS 946618 8/1956 Germany .

*Primary Examiner*—Kenneth J. Ramsey

[57] ABSTRACT

The can body to be welded in a welding station is shaped by gradually bending flat metal sheets zone by zone along a linear conveying route until the can body has been shaped. This linear conveying route at the same time leads to the welding station. In this manner can bodies can be produced and welded at a fast rate.

9 Claims, 4 Drawing Sheets

METHOD AND APPARATUS FOR SHAPING METAL SHEETS INTO CAN BODIES AND FEEDING THE CAN BODIES TO A WELDING STATION

BACKGROUND OF THE INVENTION

The invention relates to a method for shaping metal sheets into can bodies and feeding the can bodies to a welding station. The invention further relates to apparatus for carrying out said method.

Hitherto it has been usual to introduce metal sheets from a destacking table sideways into a rounding machine, in which the can body is shaped. The shaped can body is then conveyed to the welding station, where the can seam is welded. The path along which it is conveyed is L-shaped, and the metal sheets and-shaped bodies are accelerated and decelerated several times along the way. This has proved disadvantageous because modern welding stations are able to operate at a very high rate, and this presents difficulties for the conventional method of shaping and transporting the can bodies.

SUMMARY OF THE INVENTION

It is therefore the object of this invention to organize the operation of shaping and transporting the metal sheets so that the fastest possible processing rate can be achieved at the welding station.

In a method of the type mentioned above, this object is achieved by shaping each metal sheet into a can body and feeding it to the welding station, as it is travelling along a substantially linear path.

The fact that the metal sheets are no longer shaped in a rounding machine at a given point of their journey, but that shaping now takes place as they are moving, in other words continuously en route, and the fact that the path travelled is linear, not angled at 90° as is usually the case, allows can bodies to be supplied very rapidly to the welding station.

The apparatus for carrying out the method is characterised by the fact that means for shaping each metal sheet are arranged along the linear path along which said sheets are transported.

BRIEF DESCRIPTION OF THE DRAWINGS

Examples of embodiments of the invention are detailed below with reference to the accompanying drawings, wherein.

Figure 2:
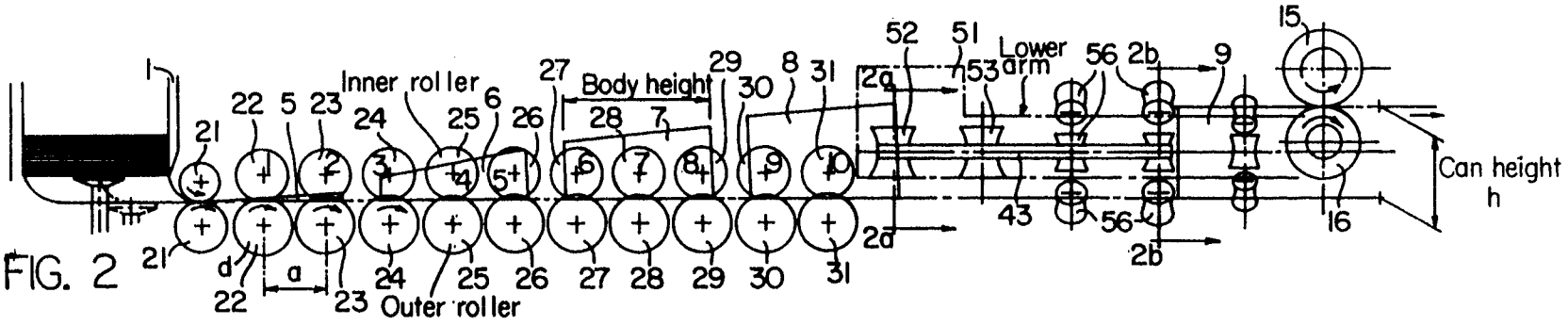
FIG. 2 is a schematic side view of the route taken from the destacking table to the welding station.
Figure 2A:
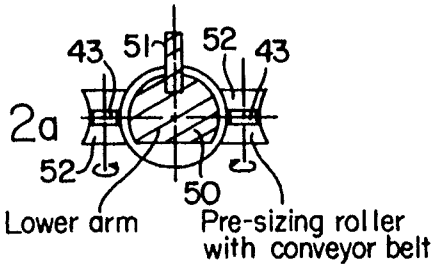
Figure 2B:
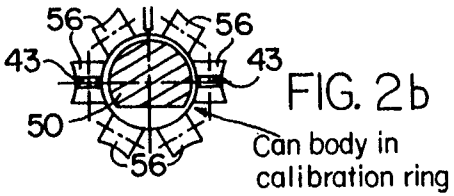

FIGS. *2a* and *2b* each show a vertical cross-section through the route seen in FIG. 2 at sections *2a—2a, 2b—2b;*

Figure 3:
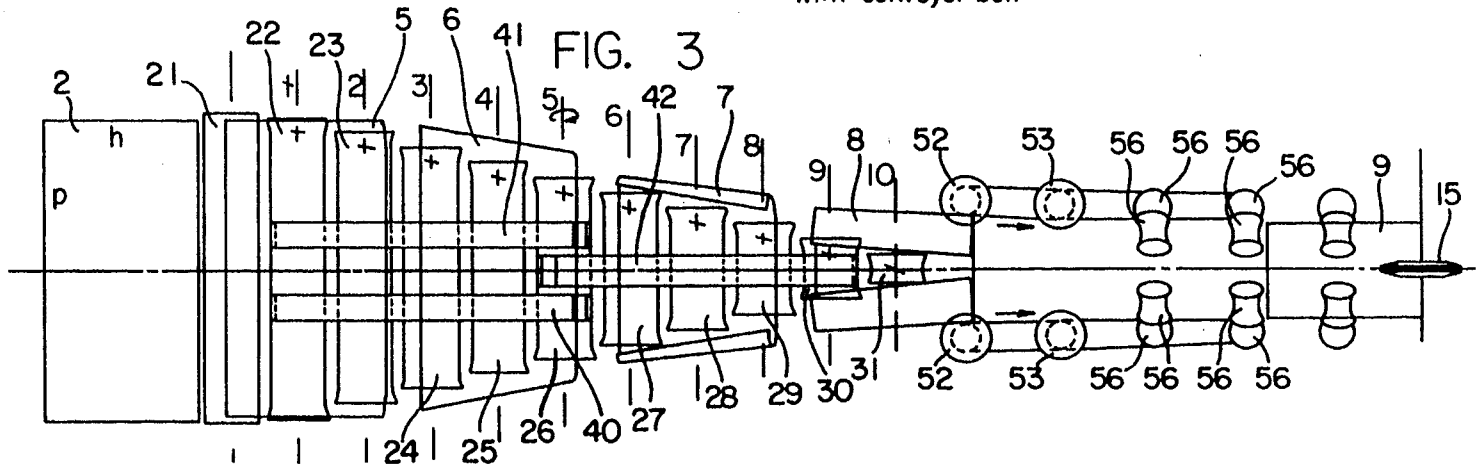
Figure 5:
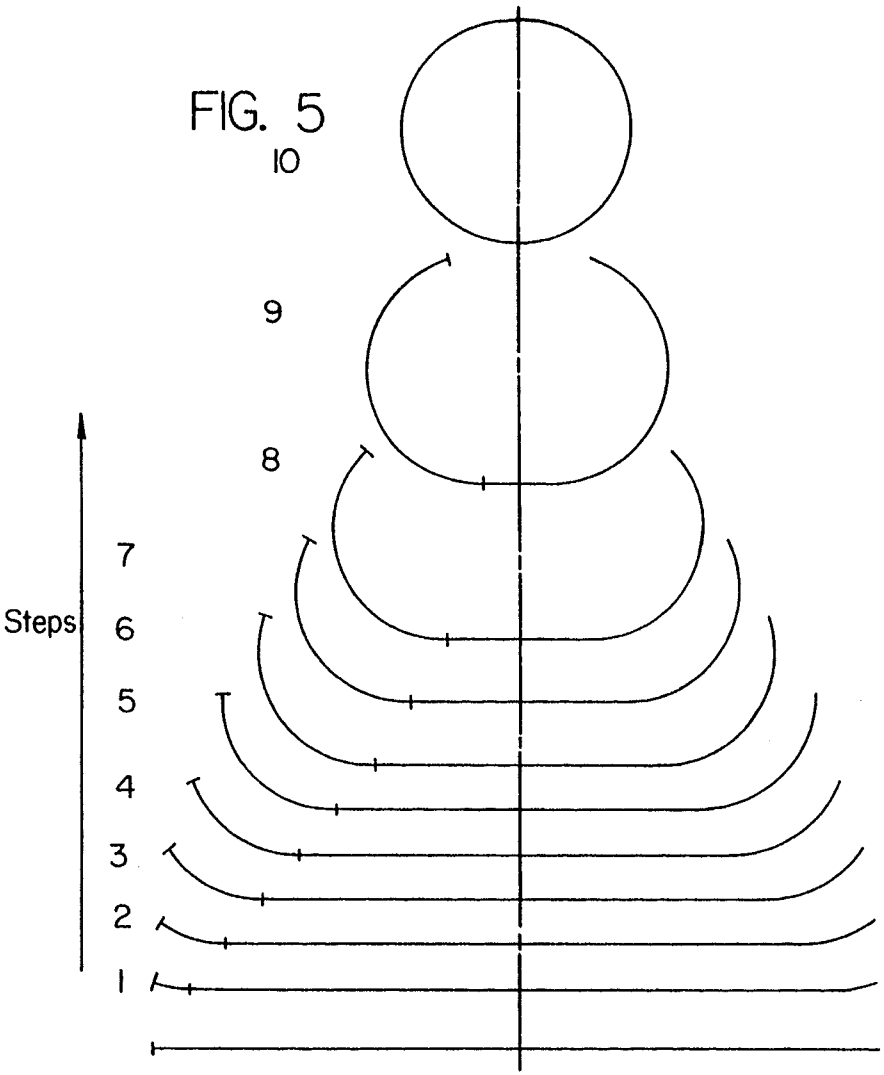
Figure 4:
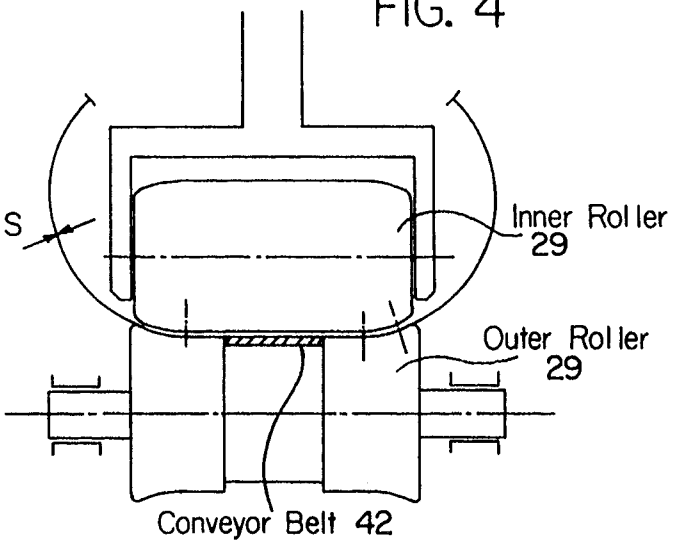
Figure 7:
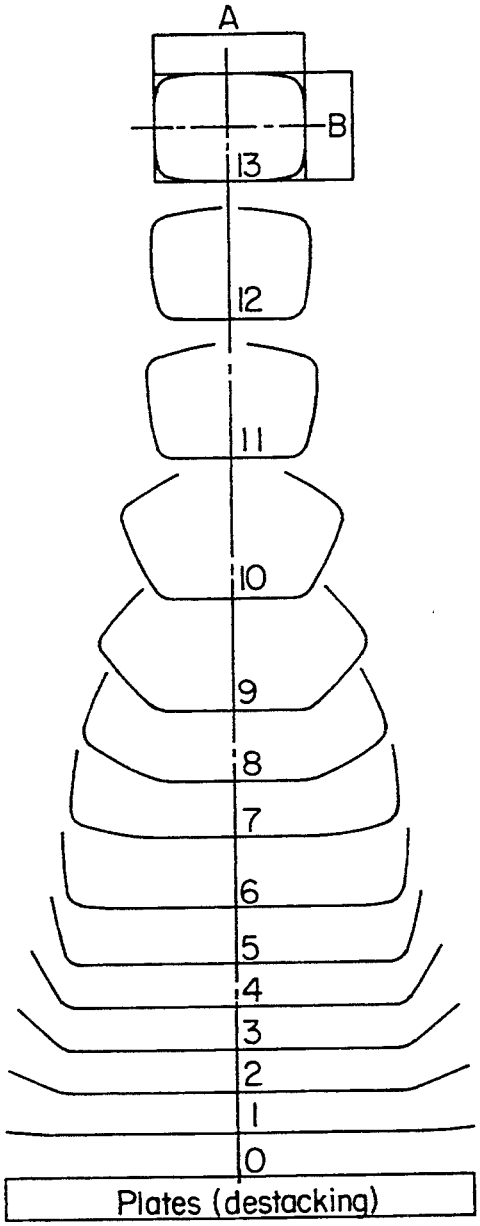

FIG. 3 is a plan view of the route seen in FIG. 2;

FIG. 4 is a schematic front view onto two rollers for shaping the can body;

FIG. 5 is a diagram showing the sequence of steps involved in shaping the metal sheet into the can body;

FIGS. *6a* to *6d* are each schematic front views of the rollers used to shape a non-cylindrical can body; and FIG. 7 shows the series of steps involved in shaping the non-cylindrical can body.

DESCRIPTION OF THE PREFERRED EMBODIMENTS

Figure 1:
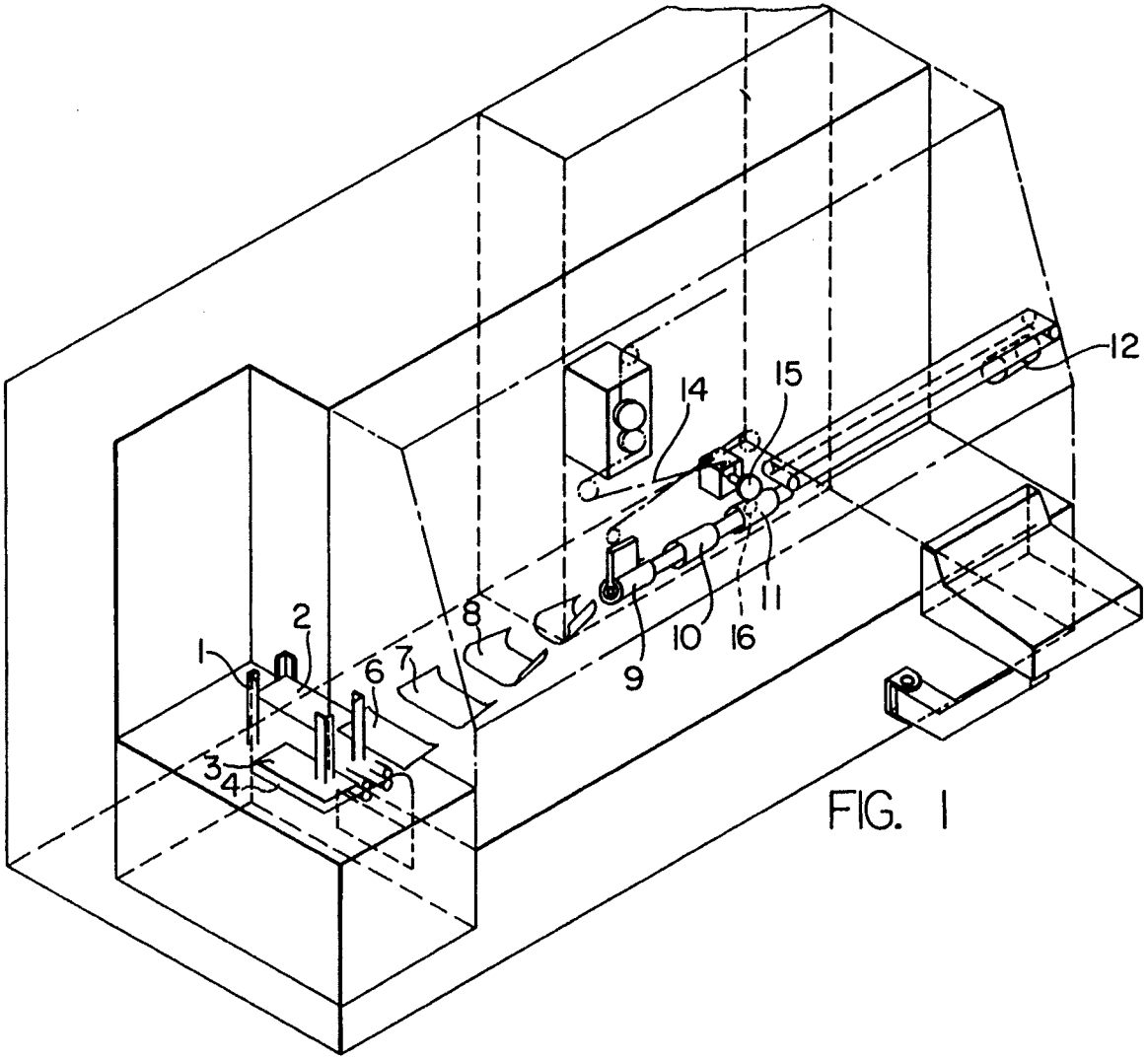
FIG. 1 is a schematic view of a machine for manufacturing can bodies.

In FIG. 1 a can welding machine is illustrated schematically. In conventional manner the machine includes an upper welding roller 15 and a lower welding roller 16, as well as a supply of welding wire 14 for welding the seam of the can body 11. The welded can body 12 is carried away for further processing. Ahead of the welding station, the metal sheets are shaped into can bodies and fed to the welding station. In accordance with the invention, this process of feeding and shaping the metal sheets is organised so that the individual metal sheets 2–10 are shaped along the way. This is depicted schematically in FIG. 1. The metal sheets start off on a destacking table 1. The stack of metal sheets is represented only by the uppermost sheet 2 and the two bottommost sheets 3 and 4. The bottommost sheet at any one time is drawn from the destacking table and moved along the straight path to the welding station. During its journey the metal sheet is gradually shaped to make the can body, as represented in FIG. 1 with the aid of sheets 5–10.

FIG. 2 is a schematic side view of the route travelled. Individual metal sheets are destacked by the destacker 1 and supplied initially to the pair of take-off rollers 21. These are followed by pairs of profiling rollers 22–31, which deform the respective metal sheets 5, 6, 7, 8 zone by zone along the route, thereby producing a can body from the initially flat metal sheet along the route.

FIG. 3 shows the same route, this time from above. The belt conveyors 40,41 and 42 are also visible which are used to convey the can bodies. The outer rollers situated beneath the metal sheet are each represented; the inner rollers situated above the metal sheet are not shown in FIG. 3.

FIG. 4 shows a front view of the pair of profiling rollers 29 to illustrate how the can body is shaped. The outer roller disposed beneath the metal sheet and the inner roller disposed above the metal sheet each have a curved outer shoulder. The associated outer shoulders of the two rollers each form a rounding zone, in which the corresponding area of the metal sheet is deformed.

FIG. 5 shows the various steps involved in deforming a flat metal sheet into a cylindrical can body in this manner. Step 1 of the deformation process indicated in FIG. 5 corresponds to the deformation effected by roller pair 22, step 2 to the deformation effected by roller pair 23, etc. Roller pair 29 shown in FIG. 4 effects the deformation indicated in step 8 of FIG. 5. In the example shown in FIG. 5, the can body is rounded sector by sector in ten steps, with each step involving rounding by $2\times18°$ sectors.

The sector rounding section of the route, formed by the pair of profiling rollers 22–31, is followed by a section of the route used to size the can bodies. For sizing purposes a lower arm 50 is provided which is attached to a mounting 51 and onto which the can body is pushed. Along the sizing section of the route are pre-sizing rollers 52 and 53 which act on the can body first. Belt conveyors 43 are also provided on the sizing section. After pre-sizing the can body passes into a sizing ring equipped with a number of sizing rollers 56. FIGS. *2a* and *2b* respectively show the pre-sizing and sizing operations in vertical cross-sectional front views. Once it has been sized, the can body is pushed into the welding station, which is known per se and hence not detailed further here.

Figure 6D:
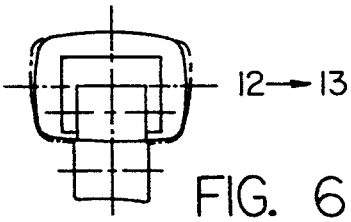
Figure 6C:
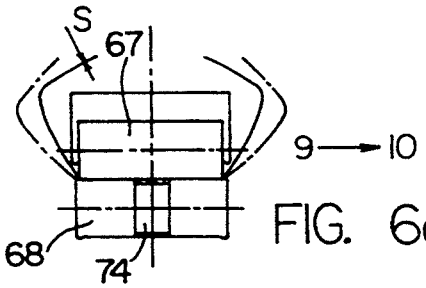
Figure 6B:
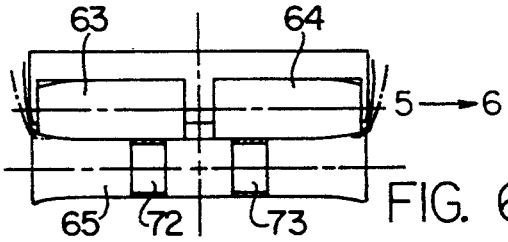
Figure 6A:
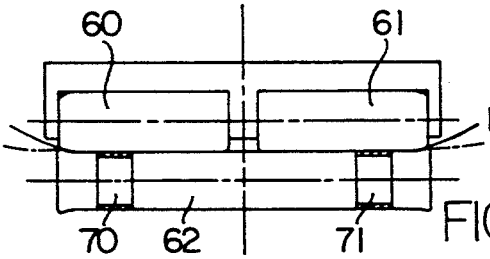

FIG. 7 shows how a non-circular can body is shaped, involving thirteen shaping steps. FIG. 6*a* shows the inner and outer rollers at the shaping stage from step 1 to step 2 in FIG. 7. FIG. 6*b* shows the rollers for the shaping stage from step 5 to step 6. FIG. 6*c* correspondingly shows the shaping stage from step 9 to step 10 and FIG. 6*d* shows the final shaping stage from step 12 to step 13.

We claim:

1. Method for shaping metal sheets into can bodies and feeding the can bodies to a welding station, comprising the steps of:

providing a series of profiling rollers disposed at both surfaces of a metal sheet along a first portion of a substantially linear conveying route leading to a welding station to preshape a can body;

providing a series of sizing rollers acting on the external surfaces of preshaped can bodies along a second portion of the conveying route;

providing at least one belt conveyor disposed on the rollers at the one surface of each metal sheet along the first and second portions of the conveying route;

taking each metal sheet from a destacking table disposed on an axis of the conveying route; and feeding each metal sheet through the profiling and sizing rollers toward the welding station by means of the at least one belt conveyor to shape the can body.

2. Method according to claim 1, wherein the step of providing at least one belt conveyor is further characterized by:

providing at least one belt conveyor for moving the metal sheets along the first portion of the conveying route; and providing at least one other belt conveyor for moving preshaped can bodies along the second portion of the conveying route.

3. Method according to claim 2, wherein the step of providing at least one belt conveyor for moving the metal sheets along the first portion of the conveying route is further characterized by providing at least two, sequential belt conveyors.

4. Apparatus for shaping metal sheets into can bodies for welding, comprising:

a linear conveying route for the metal sheets between a destacking station and a welding station;

shaping means disposed along the linear conveying route for continuous or stepwise shaping of each metal sheet and including cooperating sets of shaping rollers disposed along the conveying route, and by which sets the individual metal sheets are engaged and shaped; and at least one belt conveyor being disposed on the shaping rollers for engaging the metal sheets and conveying the metal sheets along the conveying route.

5. Apparatus according to claim 4, wherein the at least one belt conveyor is one belt conveyor disposed on shaping rollers along a first portion of the conveying route, and another belt conveyor disposed on shaping rollers along a second portion of the conveying route.

6. Apparatus according to claim 5, wherein the shaping rollers disposed along the first portion of the conveying route are profiling rollers decreasing in width along the conveying route, and each of the profiling rollers has a lateral shoulder providing a shaping zone for shaping each metal sheet into a preshaped can body.

7. Apparatus according to claim 5, wherein the shaping rollers along the second portion of the conveying route are calibrating rollers, and the belt conveyor for conveying a metal sheet along the second portion of the conveying route is disposed on the calibrating rollers on the outside of a preshaped can body.

8. Apparatus according to claim 7, further comprising:

a guide arm disposed on the second portion of the conveying route reaches into preshaped can bodies.

9. Method for shaping metal sheets into can bodies and feeding the can bodies to a welding station, comprising the steps of:

providing a series of shaping rollers disposed along a conveying route leading to a welding station to preshape a metal sheet into a can body and act on the external surface of a preshaped can body;

providing at least one belt conveyor disposed on the shaping rollers and engaging at least one surface of each metal sheet and preshaped can body along the conveying route;

taking each metal sheet from a destacking table disposed on an axis of the conveying route; and feeding each metal sheet through the shaping rollers toward the welding station by means of the at least one belt conveyor disposed on the shaping rollers to shape each metal sheet into a can body.

* * * * *